US005951906A

United States Patent [19]

Sung

[11] Patent Number: 5,951,906

[45] Date of Patent: Sep. 14, 1999

[54] COLLAPSIBLE MICROWAVE OVEN

[75] Inventor: Han-Jun Sung, Suwon, Rep. of Korea

[73] Assignee: Samsung Electronics Co., Ltd., Suwon, Rep. of Korea

[21] Appl. No.: 09/135,587

[22] Filed: Aug. 18, 1998

[30] Foreign Application Priority Data

Apr. 8, 1998 [KR] Rep. of Korea ..... 98-12463

[51] Int. Cl.[6] ..... H05B 6/80

[52] U.S. Cl. ..... 219/756; 219/736; 219/739

[58] Field of Search ..... 219/756, 757, 219/736, 739; 174/35 R

[56] References Cited

U.S. PATENT DOCUMENTS 4,100,463 7/1978 Sugie ..... 219/756

5,235,150 8/1993 Buske et al. ..... 219/756

FOREIGN PATENT DOCUMENTS 61-291833 12/1986 Japan ..... 219/756

*Primary Examiner*—Philip H. Leung

*Attorney, Agent, or Firm*—Burns, Doane, Swecker & Mathis, L.L.P.

[57] ABSTRACT

A collapsible microwave oven includes a main body, a cooking chamber defined within the main body, a magnetron for radiating high frequency microwaves to the cooking chamber, a high voltage transformer for applying high voltage to the magnetron, and an electronic component case containing the magnetron and the high voltage transformer. The electronic component case is mounted on the main body to be insertable into and withdrawable from the main body, whereby the space occupied by the oven can be reduced when the oven is not in use.

9 Claims, 4 Drawing Sheets

COLLAPSIBLE MICROWAVE OVEN

BACKGROUND OF THE INVENTION

1. Field of the Invention

The present invention relates to a microwave oven and, more particularly, to a microwave oven which occupies less space when not in use.

2. Description of the Related Art

Generally, a microwave oven cooks food using microwaves radiated from a magnetron.

FIG. 1 shows a perspective view illustrating a conventional microwave oven.

The microwave oven comprises a main body 10 having an outer case 11 and an inner case 12 defining a cooking chamber 20.

A door 30 for opening and closing the cooking chamber 20 is rotatably mounted on a front side of the inner case 12. A control panel for selecting cooking time and mode is also mounted on the front side of the inner case 12. A cooking tray 21 is disposed on a bottom of the cooking chamber 20.

Disposed between a right plate 12*a* of the inner case 12 and a right plate 11*a* of the outer case 11 is an electronic component chamber 40 in which are disposed a magnetron 41 for radiating high frequency microwaves into the cooking chamber 20, and a high voltage transformer 42 for applying high voltage to the magnetron 41. In addition, a cooling fan 43 for forcing air into the electronic component chamber 40 and a guide duct 44 for guiding the air into the cooking chamber 20 are also disposed in the electronic component chamber 40.

In the above described microwave oven, after food to be cooked is disposed within the cooking chamber 20, when the oven is operated by adjusting the control panel 31, the magnetron 41 radiates the high frequency microwaves into the cooking chamber 20.

However, since the electronic component chamber and the cooking chamber are fixedly defined within the main body, a fixed space is required regardless of whether the microwave oven is being used. Therefore, the conventional microwave oven cannot use space efficiently.

SUMMARY OF THE INVENTION

Therefore, the present invention is made in an effort to solve the above described problems.

It is an object of the present invention to provide a microwave oven in which an electronic component case for mounting electronic components can be mounted to be insertable into and withdrawable from a microwave oven body so space can be saved by inserting the case into the body when the microwave oven is not used.

To achieve the above object, the present invention provides a microwave oven comprising a main body, a cooking chamber defined within the main body, a magnetron for radiating high frequency microwaves to the cooking chamber, a high voltage transformer for applying high voltage to the magnetron, and an electronic component case containing the magnetron and the high voltage transformer. The electronic component case is mounted on the main body for movement relative thereto to be insertable inside and withdrawable out of the main body.

A rectangular opening is formed on a side of the main body so that the electronic component case can be inserted and withdrawn therethrough. A guide flange for guiding the insertion and withdrawal of the electronic component case is disposed around the rectangular opening such that the guide flange extends from inside of the cooking chamber to the outside of the main body.

A stopper flange is formed around an inner plate of the electronic component case to control maximum withdrawal of the case. The stopper flange contacts a front end of the guide flange when the electronic component case is fully withdrawn.

A rubber ferrite is attached on the stopper flange to create a seal around the opening and prevent leakage of high frequency microwaves between the flange and the guide flange.

A push button switch is disposed on a side plate of the cooking chamber. Electric power of the microwave oven is controlled by a push button switch that is contacted by the rubber ferrite when the electronic component case is fully withdrawn.

A cover member is attached on an outer end of the electronic component case to enclose the guide flange when the electronic component case is fully withdrawn.

A roller is attached on a lower end of the cover member to aid the smooth movement of the electronic component case while supporting the case.

A handle is attached on an outer surface of the cover member.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS OF THE INVENTION

A preferred embodiment of the present invention will now be described in detail with reference to the accompanying drawings.

Figure 1:
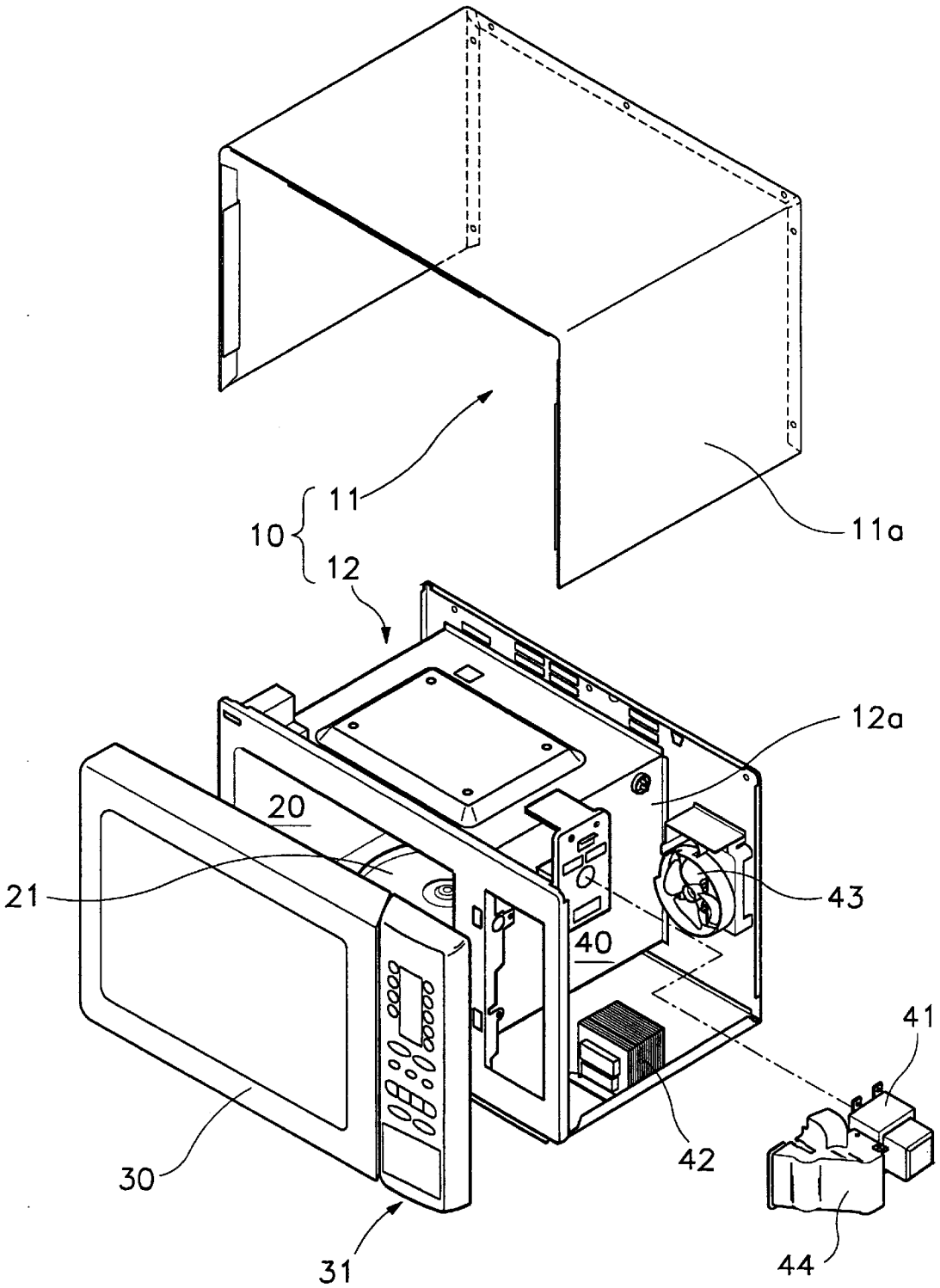
FIG. 1 (PRIOR ART)
FIG. 1 is an exploded perspective view illustrating a conventional microwave oven.
Figure 2:
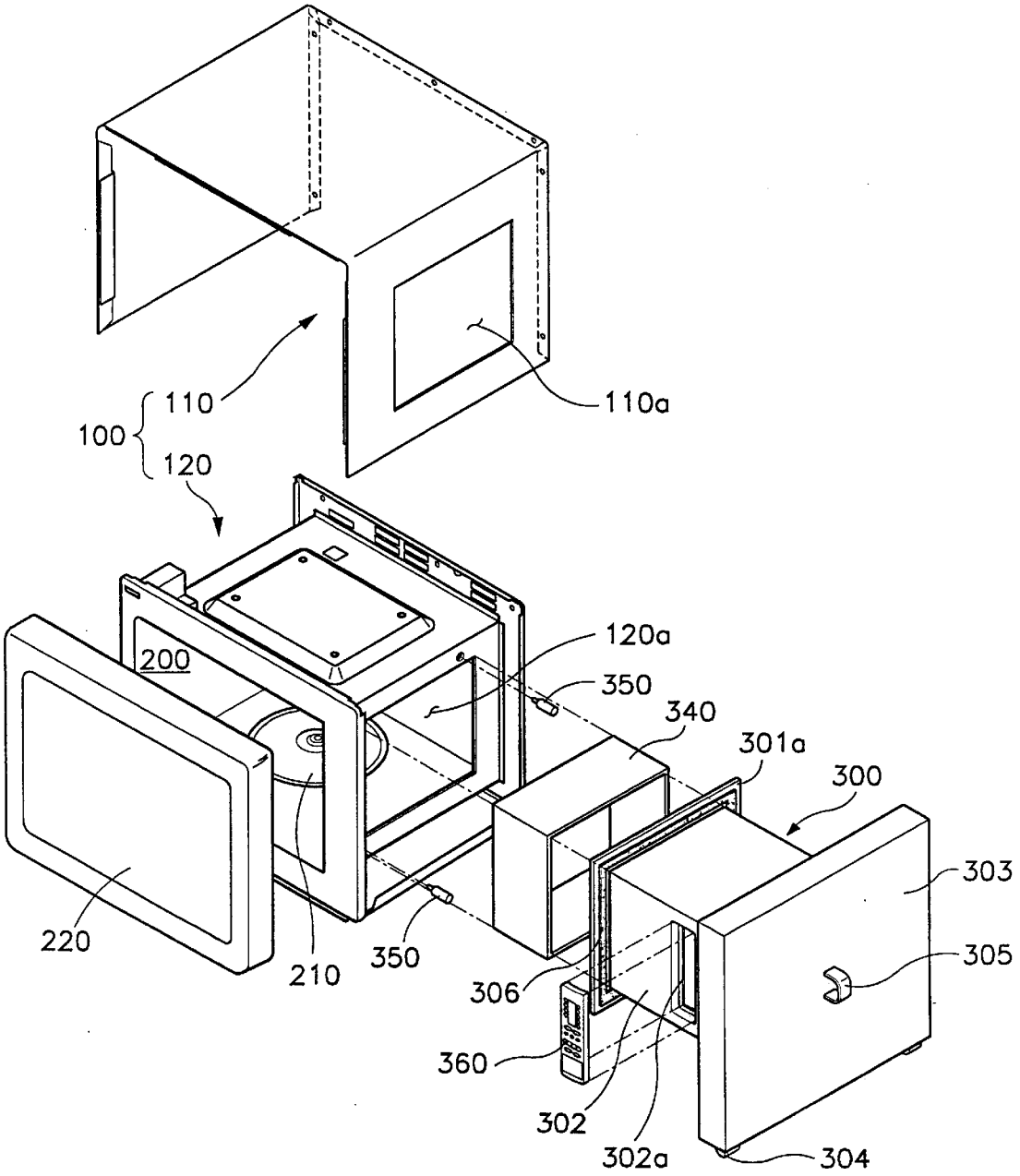
FIG. 2 is an exploded perspective view illustrating a microwave oven according to a preferred embodiment of the present invention.

FIG. 2 shows an exploded perspective view illustrating a microwave oven according to a preferred embodiment of the present invention.

A microwave oven comprises a main body 100 having an outer case 110 and an inner case 120 defining a cooking chamber 200.

A door 220 for opening and closing the cooking chamber 200 is rotatably mounted on a front side of the inner case 120. A cooking tray 210 is disposed on a bottom of the cooking chamber 20.

According to a feature of the present invention, the oven is collapsible in that an electronic component case 300 in which electronic components are mounted is disposed to be insertable into and withdrawable from the main body 100.

Figure 3:
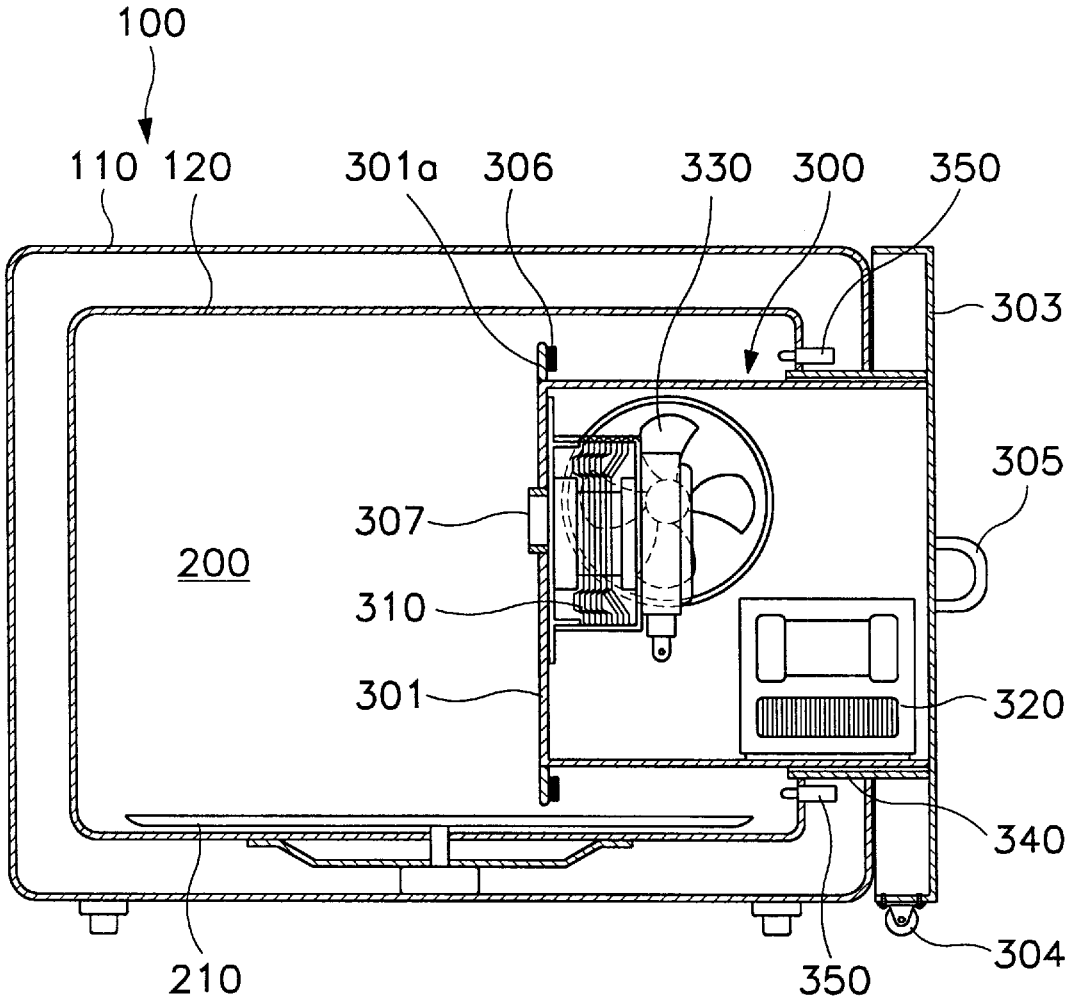
FIG. 3 is a vertical sectional view of a microwave oven according to a preferred embodiment of the present invention, wherein an electronic component case is fully inserted.
Figure 4:
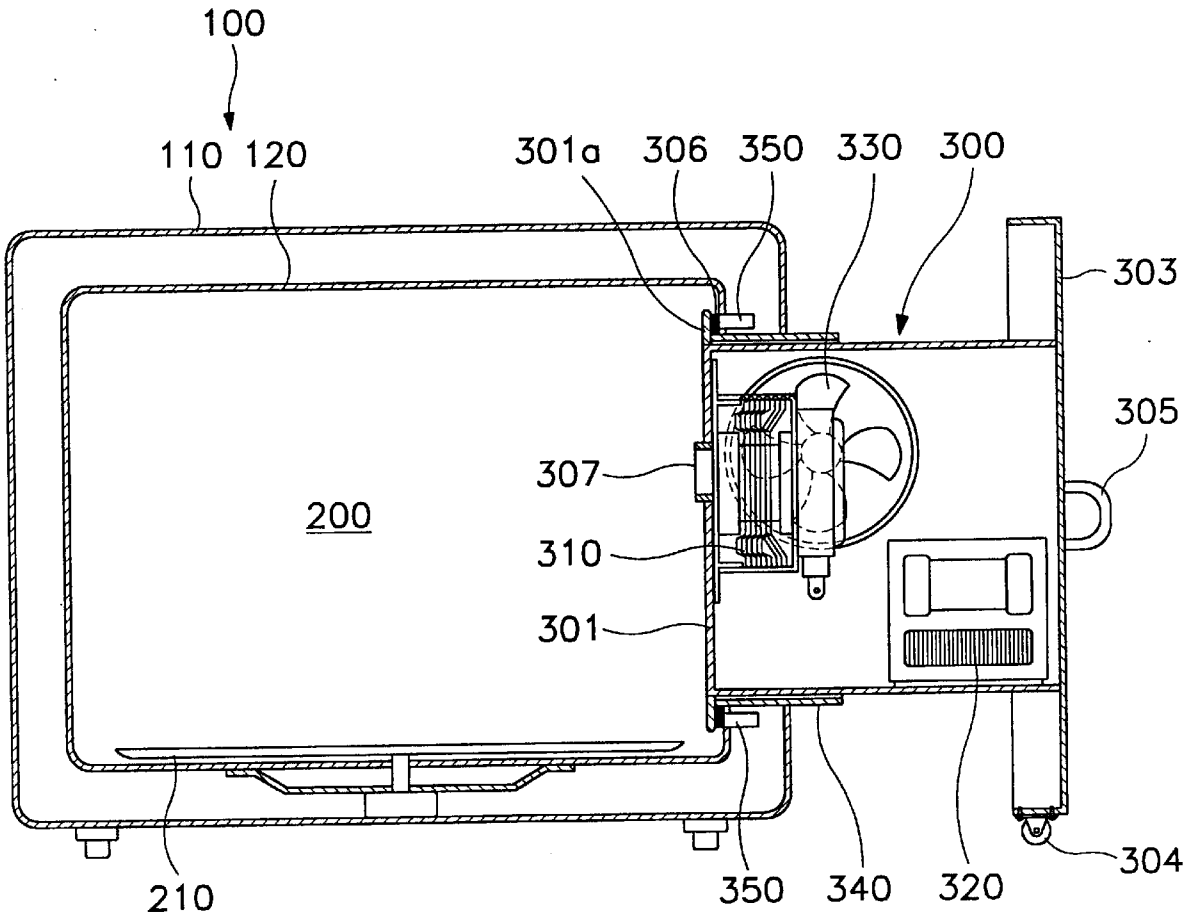
FIG. 4 is a vertical sectional view of a microwave oven according to a preferred embodiment of the present invention, wherein an electronic component case is fully withdrawn.

FIGS. 3 and 4 show side sectional views of a microwave oven according to a preferred embodiment of the present invention.

The electronic component case 300 generally contains a magnetron 310 for radiating high frequency microwaves into the cooking chamber 200 and a high voltage transformer 320 for applying high voltage to the magnetron. In addition, a cooling fan 330 for forcing air into the electronic component case 300 and a guide duct (not shown) for guiding the air into the cooking chamber 200 are also disposed in the electronic component case 300.

The electronic component case 300 is withdrawn out of the main body 100 when the microwave oven is used, and is inserted into the main body 100 when the same is not used. This structure enables the space used by the microwave oven to be reduced when the same is not being used. This will be described more in detail hereinafter.

Rectangular openings 110*a* and 120*a* are respectively formed on the outer and inner cases 110 and 120 so that the electronic component case 300 can be inserted and withdrawn therethrough. A guide member in the shape of a flange 340 for guiding the insertion and withdrawal of the electronic component case 300 is disposed around the rectangular openings 110*a* and 120*a* such that the guide member extends from an inside of the cooking chamber 200 to an outside of the outer case 110.

A stopper flange 301*a* is formed around an inner plate 301 of the case 300 to control maximum withdrawal of the case. That is, as shown in FIG. 4, when the electronic component case 300 is fully withdrawn, since the stopper flange 301*a* contacts the front end of the guide member 340, the electronic component case 300 is prevented from being removed from the main body 100. In addition, when the electronic component case 300 is fully withdrawn, a rubber ferrite, attached on the stopper flange 301*a*, tightly contacts the inner wall of the cooking chamber 200 to prevent the leakage of high frequency microwaves through a space between the guide 340 and the stopper flange 301*a*, To radiate the high frequency microwaves generated from the magnetron 310 into the cooking chamber 200, a frequency passing tube 307 is mounted on the inner plate 301 of the electronic component case 300.

A push button switch 350 is mounted on a side plate of the inner case 120 to be contacted by the rubber ferrite 306 when the electronic component case 300 is fully withdrawn. The electric power applied to the microwave oven is turned on or off by the operation of push button switch 350. That is, when the electronic component case 300 is fully withdrawn, the rubber ferrite 306 presses the push button switch 350 to apply the electric power to the microwave oven. When the microwave oven is not used, as soon as the electronic component case 300 begins its insertion, the push button switch 350 is turned off to cut off the electric power to the microwave oven.

In this embodiment, as shown in FIG. 2, it is preferable to provide a plurality of push button switches 350 so that the electric power is applied to the microwave oven only when the rubber ferrite 306 of the flange 301*a* pushes all of the switches 350. This may also function as detecting means for detecting whether the flange 301*a* tightly contacts the guide 340, thereby preventing the leakage of the high frequency microwaves caused by the deformation of the flange 301*a* or the rubber ferrite 306.

A control panel 360 for controlling the cooking mode and time is disposed on a seating portion 302*a* formed on a front plate 302 of the electronic component case 300. The seating portion 302*a* is recessed within the electronic component case 300 so that the control panel 360 is flush with the front plate 302, thereby preventing blockage of the insertion and withdrawal of the electronic component case 300. A cover member 303 is attached on an outer end of the electronic component case 300. The cover member 303, when the electronic component case 300 is fully inserted, encloses the guide member 340 to enhance the exterior appearance of the microwave oven. A plurality of rollers 304 are attached on a lower end of the cover member 303 to aid the smooth movement of the electronic component case 300 while supporting the case 300. A handle 305 is attached on an outer surface of the cover member 303.

The operation of the above described microwave oven will be described hereinafter.

When the microwave oven is not used, as shown in FIG. 3, the electronic component case 300 is inserted into the cooking chamber 200. Therefore, the space occupied by the microwave oven can be reduced. At this point, since the flange 301*a* is distanced from the push button switch 350, the electric power is turned off so that the microwave oven is not operated.

To use the microwave oven, the electronic component case 300 is withdrawn out of the main body 100 until the flange 301*a* contacts the front end of the guide member 340. Thus, the rubber ferrite 306 attached on the flange 301*a* pushes the push button switch 350 to apply the electric power to the microwave oven.

After this, food to be cooked is positioned within the cooking chamber 200. The control panel 360 is manipulated by the user to operate the microwave oven in a state where the door 220 is closed. The high frequency microwaves generated from the magnetron 310 are conducted into the cooking chamber 200 through the frequency passing tube 307, thereby cooking the food.

After the cooking is completed, the electronic component case 300 is inserted into the cooking chamber 200, thereby cutting off the electric power.

While the invention has been described in connection with what is presently considered to be most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A collapsible microwave oven comprising:

a main body;

a cooking chamber defined within the main body;

a magnetron for radiating high frequency microwaves to the cooking chamber;

a high voltage transformer for applying high voltage to the magnetron; and an electronic component case containing the magnetron and the high voltage transformer, the electronic component case being mounted on the main body for movement relative thereto to be insertable into the main body and the cooking chamber when the oven is not in use, and withdrawable out of the cooking chamber and the main body when the oven is to be used.

2. The microwave oven of claim 1 wherein a rectangular opening is formed on a side of the main body through which the electronic component case is slidable, and a guide flange for guiding the insertion and withdrawal of the electronic component case is disposed around the rectangular opening, the guide flange extending from within the cooking chamber to the outside of the main body.

3. The microwave oven of claim 2 wherein the electrical component case includes an inner plate and a stopper flange disposed around the inner plate to control maximum withdrawal of the case, the stopper flange contacting a front end of the guide flange when the electronic component case is fully withdrawn.

4. The microwave oven of claim 3 wherein the electric component case further includes a rubber ferrite attached on the stopper flange to create a seal around the opening when the case is withdrawn, for preventing leakage of high frequency microwaves.

5. The microwave oven of claim 3 wherein a cover member is attached on an outer end of the electronic component case to enclose the guide member when the electronic component case is fully withdrawn.

6. The microwave oven of claim 5 wherein a roller is attached on a lower end of the cover member to aid the smooth movement of the electronic component case while supporting the case.

7. The microwave oven of claim 6 wherein a pull handle is attached on an outer surface of the cover member.

8. The microwave oven of claim 1 wherein a switch is disposed on a side plate of the cooking chamber for being contacted by a portion of the electric component case to supply electric power to the microwave oven when the electronic component case is fully withdrawn.

9. The microwave oven according to claim 8 wherein the main body includes an opening through which the case is slidable, when being inserted and withdrawn, the case including a rubber ferrite arranged to provide a seal around the opening when the case is withdrawn, the ferrite comprising the portion of the case which contacts the switch.

* * * * *